US012618290B2

(12) United States Patent
Mononen et al.

(10) Patent No.: US 12,618,290 B2
(45) Date of Patent: May 5, 2026

(54) APPARATUS, ROCK DRILLING RIG AND DRILLING METHOD

(71) Applicant: SANDVIK MINING AND CONSTRUCTION OY, Tampere (FI)

(72) Inventors: Mikko Mononen, Tampere (FI); Jarkko Jantti, Tampere (FI); Mikko Viinikainen, Tampere (FI); Hannu Iloranta, Tampere (FI); Miro Saarela, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/820,518

(22) Filed: Aug. 30, 2024

(65) Prior Publication Data

US 2025/0075560 A1 Mar. 6, 2025

(30) Foreign Application Priority Data

Sep. 1, 2023 (EP) ..... 23194773

(51) Int. Cl.
*E21B 7/02* (2006.01)

(52) U.S. Cl.
CPC ..... *E21B 7/025* (2013.01); *E21B 7/022* (2013.01)

(58) Field of Classification Search
CPC ..... E21B 7/025; E21B 7/022
See application file for complete search history.

(56) References Cited

U.S. PATENT DOCUMENTS

| | | | | |
|---|---|---|---|---|
| 9,476,256 | B2 | 10/2016 | Pursimo et al. | |
| 2004/0216922 | A1* | 11/2004 | Koivunen | E21B 7/025 175/24 |
| 2006/0190124 | A1* | 8/2006 | Makela | G05D 1/028 700/213 |
| 2014/0110168 | A1* | 4/2014 | Pursimo | E21B 7/025 701/50 |
| 2017/0138192 | A1* | 5/2017 | Wang | E21D 9/003 |
| 2022/0162911 | A1* | 5/2022 | Pesola | E21B 7/025 |
| 2023/0059996 | A1* | 2/2023 | Makela | E21F 13/00 |
| 2024/0012428 | A1* | 1/2024 | Lehtinen | G05D 1/0297 |

FOREIGN PATENT DOCUMENTS

EP 3385494 A1 10/2018

* cited by examiner

*Primary Examiner* — Taras P Bemko
(74) *Attorney, Agent, or Firm* — Corinne R. Gorski

(57) ABSTRACT

An apparatus, rock drilling rig and drilling method is provided. The apparatus provides position control data for controlling positioning a rock drilling unit of a rock drilling rig arranged for drilling transverse drill hole patterns in an underground tunnel. The apparatus includes a teaching feature for gathering data on manually controlled movements at the location of the drill hole pattern and to thereby detect a movement path, which is collision free. The data on the taught collision free movement path is implemented when controlling the rock drilling unit during an actual drilling phase.

6 Claims, 3 Drawing Sheets

APPARATUS, ROCK DRILLING RIG AND DRILLING METHOD

RELATED APPLICATION DATA

This application claims priority under 35 U.S.C. § 119 to EP Patent Application No. 23194773.0, filed on Sep. 1, 2023, which the entirety thereof is incorporated herein by reference.

TECHNICAL FIELD

The invention relates to an apparatus for providing position control data for controlling positioning of a rock drilling unit of a rock drilling rig for drilling transverse drill hole patterns to an underground tunnel or space. The invention further relates to a rock drilling rig and method.

BACKGROUND

In underground mines and construction sites different type of rock drilling rigs are used. The rock drilling rigs are provided with one or more drilling booms and rock drilling units are arranged at distal ends of the booms for drilling drill holes. The purpose of drilling holes in rock may be forming blast holes for detaching rock material by blasting, or the drill holes may be drilled in order to reinforce the rock surface by mounting rock bolts or other reinforcements inside the drilled holes. Typical underground tunnels, wherein the drilling and bolting measures are executed, are narrow wherefore there exist a risk to collisions. The present rock drilling and bolting solutions have shown to contain some disadvantages especially regarding collision examination.

SUMMARY

An object of the invention is to provide a novel and improved apparatus, rock drilling rig and method for providing collision free positioning data.

An idea of the disclosed solution is that the apparatus provides position control data for controlling positioning of a rock drilling unit for drilling transverse drill hole patterns to an underground tunnel. The apparatus utilizes a teaching procedure for providing data on manually controlled movements at the location of the drill hole pattern to be drilled. The aim is to detect a movement path which is collision free. The data on the taught movement path can be implemented when controlling the rock drilling unit during an actual drilling phase.

The teaching and producing measures of the collision free movement path are preliminary phases executed before the following actual rock drilling and other measures are initiated.

In other words, the disclosed apparatus includes at least one control unit provided with sensing data on position and orientation of the rock drilling unit. The apparatus is provided with the teaching feature wherein the apparatus is configured to gather sensing data on manually controlled movements of the rock drilling unit at the drill hole pattern to be drilled and wherein the rock drilling unit is moved along a movement path at a distance from physical obstacles located at the drill hole pattern to be drilled. The apparatus is configured to generate the collision free movement path in response of the gathered sensing data.

An advantage of the disclosed solution is that collision of the rock drilling unit to rock surfaces and other physical obstacles can be prevented when the rock drilling unit is moved during the actual drilling in accordance with the defined collision free movement path. The disclosed preparative function takes only little extra time and does not thereby cause significant delay for the actual rock drilling.

A further advantage is that the disclosed solution does not require any separate and specific sensing devices such as spatial sensors. Instead, the disclosed solution implements sensing data gathered by existing sensors arranged to boom joints and rock drilling units of the rock drilling rigs. Thereby, the present solution may be simple, durable, and inexpensive.

According to an embodiment, the manual movement or teaching is a collision free movement phase wherein the rock drilling unit is moved on the plane of the drill hole pattern to be drilled.

Herein, the rock drilling rig refers to a rock bolter and a long hole drilling rig, which both include the rock drilling units, and are used for drilling drill hole patterns in a transverse direction to a tunnel.

According to an embodiment, the drill hole pattern is a rock bolt pattern for providing the rock surface limiting the tunnel with rock reinforcing rock bolts or cable bolts. The apparatus is arranged for assisting drilling of drill holes for the rock bolts and cable bolts. The rock drilling rig may be a rock bolter, or a cable bolter, provided with at least one bolting head including the rock drilling unit and means for feeding the rock bolts or rock supporting cables. In this case, the generated collision free movement path includes avoiding collision of the entire bolting head including the rock drilling unit and the bolt or cable feeding apparatuses. When grouting material is fed to the drilled holes together with the rock bolts or the cable bolts, then the collision free movement path may also include avoiding collision of grouting material feed apparatuses and elements. However, the grouting feed means, as well as rock bolt magazines and cable bolt feeding and cutting devices, can be considered to be part of the bolting head.

According to an embodiment, the drill hole pattern is a production blast hole pattern. The production blast hole pattern is also known as a long hole pattern. The drill holes of the pattern are charged with explosive material after the drilling is completed and are blasted for removing rock material.

According to an embodiment, the physical obstacles limiting the collision free movement path of the rock drilling unit may include the realized tunnel profile. i.e., rock surfaces such as walls, ceiling, and floor of the tunnel.

In addition, there may be limiting rock surfaces not only in the transverse direction of the tunnel but also in the length direction of the tunnel.

Physical obstacles may include possible infrastructure arranged to the tunnel. The infrastructure may include, for example, ventilation ducts, water pipes, hoses, electrical cables, and possible other structures and elements.

Further, the physical obstacles may include structures of the rock drilling rig itself. The collision free movement path includes avoiding colliding with a boom carrying the rock drilling unit, or with other booms of the rock drilling rig. Collision to a carrier of the rock drilling rig is also avoided.

Thus, the teaching of the collision free movement path can include avoiding all kind of physical obstacles forming collision risks at the drill hole pattern to be drilled.

According to an embodiment, the apparatus is part of a control unit of the rock drilling rig.

Alternatively, the apparatus is a separate device and may be located external to the rock drilling rig. Accordingly, the apparatus may be a server or external control device communicating with the control unit of the rock drilling rig.

According to an embodiment, the apparatus is configured to examine a position of at least one selected point of the rock drilling unit and is configured to generate the collision free movement path for the at least one selected point. In other words, the apparatus calculates the collision free movement path for the selected point on the basis of the gathered sensing data and input data on dimensions and kinematics of the rock drilling unit. The apparatus can calculate the collision free movement path for any point on the rock drilling unit.

An alternative is to select a virtual or calculated point to be examined when determine the collision free movement path. Thus, the selected point may be even outside the physical structure of the rock drilling unit or boom.

According to an embodiment, the selected at least one point may be a bit of a rock drilling tool, or a front end of a feed beam, for example.

Alternatively, the selected point may be a rear end of the feed beam. This may be the case when there occurs a risk of colliding with a floor or bottom of the tunnel. Further, any other point considered to be critical to collision may be selected as the monitored point.

According to an embodiment, the apparatus is configured to examine positions of at least two selected points, which are located at opposite ends of the rock drilling unit and configured to generate the collision free movement path for the selected points.

According to an embodiment, when the rock drilling unit is part of a bolting head of a rock bolter, then one or more points on the bolt feeding apparatuses can also be selected for the collision examination.

According to an embodiment, the apparatus is configured to examine orientation of the rock drilling unit in addition to the position of the selected at least one point and is configured to generate the collision free movement path and orientation for the at least one selected point.

According to an embodiment, the apparatus is configured to implement the generated collision free movement path for generating control commands for automatic coarse positioning of the rock drilling unit on the plane of the drill hole pattern to defined locations of the drill holes of the drill hole pattern.

In other words, the coarse positioning movements may include turning the rock drilling unit to defined orientations of the drill holes of the drill hole pattern. The location data can include position data of drill hole start points in addition to the orientation data.

After the rock drilling unit is coarse positioned and is directed towards a start point of the drill hole a fine positioning is initiated. The rock drilling unit is moved in a feed direction towards the start point until a drill bit or structure of the rock drilling unit is in contact with a rock surface. Typically the rock drilling unit is supported against the rock surface. The fine positioning movements may be executed with slow speed or under control of an operator.

According to an embodiment, the apparatus is provided with a drilling plan pre-designed for the drill hole pattern and the apparatus is configured to control the automated coarse positioning of the rock drilling rig in accordance with the provided drilling plan. The drilling plan may include at least start point coordinates and end point coordinates of the drill holes. If needed, the control unit can also calculate angles of orientation and lengths of the drill holes.

The drilling plan needs to be navigated for drilling a drill hole pattern prior to initiating the actual drilling. In the navigation the drilling plan is connected to a current drilling site. The realized tunnel profile and physical obstacles therein can be examined by means of the disclosed teaching phase simultaneously when the navigation process is executed. The simultaneous execution of the two processes, navigation and the collision free movement path search, saves time needed for the preparative measures.

According to an embodiment, the apparatus or a control unit of the rock drilling rig is provided with a design feature assisting an operator to define parameters for the drill hole pattern to be drilled. Thus, it is possible to design the drill hole pattern semi-automatically on a display device of a rock drilling rig, for example.

According to an embodiment, it is possible to move the drilling unit somewhere inside the taught and generated primary collision free movement path. Thus, there may be a secondary collision free movement path which is at a tolerance distance from the primary movement path. This way, an extra distance from the physical obstacles can be defined for the entire movement path, or only at selected sections of the movement path. However, when the rock drilling unit is moved along the defined primary collision free movement path, then it is located close to the rock surfaces and fine positioning measures towards the start points of the drill holes are quick to execute.

According to an embodiment, the apparatus is further provided with sensing data on manually controlled movements of the rock drilling unit in a transverse direction of the plane of the drill fan and at a transverse distance from physical obstacles in the transverse direction whereby the generated collision free movement path has three-dimensional configuration. In other words, there may be physical obstacles that protrude in the longitudinal direction of the tunnel at the location of the drill hole fan. Thus, when teaching the safe movement path, the rock drilling unit cannot be moved only on the plane of the drill hole fan but needs to be moved also in the transverse direction when tracing the transverse obstacles. Therefore, the generated collision free movement path has a third dimension in the transverse direction to the plane of the drill hole fan. The collision free movement path is predominantly on the plane but may include deviating sections at the locations of the transverse objects.

According to an embodiment, the apparatus is configured to provide data on realized tunnel profile of the tunnel in response to the received sensing data. In other words, the teaching phase provides approximate sensing data on rock surfaces at the drill hole fan and this data can be used to generate an approximation of the realized tunnel profile. Comparison between the realized tunnel profile and a designed tunnel profile can be executed and the results can be utilized for examining how well the rock excavation process has succeeded and properties of the excavated rock, for example.

The rock drilling unit is not in contact with the rock surface during the teaching of the collision free movement path, therefore the sensing data of the tunnel profile is the approximate sensing data and not an accurate tunnel profile.

According to an embodiment, the apparatus is configured to present on a display device approximation of the realized tunnel profile and the designed tunnel profile. Of course, the taught collision free movement path can also be displayed.

According to an embodiment, the disclosed solution relates also to a rock drilling rig for drilling transverse drill hole patterns to rock surfaces of an underground tunnel. The rock drilling rig includes: a movable carrier; at least one boom; at least one rock drilling unit supported on the at least one boom and including at least a feed beam and a rock drilling machine mounted movably on the feed beam; sensing devices for generating sensing data on movements of the boom and the rock drilling unit; and a control unit for controlling operation of the rock drilling rig. The control unit of rock drilling rig is provided data on a collision free movement path at the drill hole pattern to be drilled and is configured to implement the collision free movement path in position control of the rock drilling unit. The collision free movement path is generated by means of an apparatus which is in accordance with the features and embodiments disclosed in this document.

According to an embodiment, the rock drilling rig is a bolting rig including a bolting head supported on the boom and the bolting head includes at least a rock bolt or cable feeding apparatus in addition to the rock drilling unit.

According to an embodiment, the disclosed solution relates also to a method of drilling transverse drill hole patterns to rock surfaces of an underground longitudinal tunnel. The method includes: drilling the drill holes of the drill hole patterns by means of a rock drilling rig including at least one rock drilling unit; executing a preparative detection of physical obstacles at the drill hole pattern prior initiating the drilling of the drill holes of the drill hole pattern; detecting the physical obstacles at the drill hole pattern by moving the rock drilling unit under control of an operator adjacent to physical objects including at least inner surfaces of the tunnel and thereby teaching a collision free movement path; and storing the detected collision free movement path and utilizing the stored collision free movement path in a position control of the rock drilling unit when drilling the drill holes.

According to an embodiment, the method further includes moving the rock drilling unit at a distance from the physical obstacles whereby the detection of the physical obstacles is contactless.

According to an embodiment, the method further includes implementing continuous manual movement of the rock drilling unit for the detection of the physical obstacles.

According to an embodiment, the method further includes selecting at least one point of the rock drilling unit to be examined when detecting the physical obstacles; storing the movements of the at least one selected point as the collision free movement path; and monitoring during the drilling movements of the selected at least point in relation to the stored collision free movement path.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

For the sake of clarity, the figures show some embodiments of the disclosed solution in a simplified manner. In the figures, like reference numerals identify like elements.

DETAILED DESCRIPTION

Figure 1:
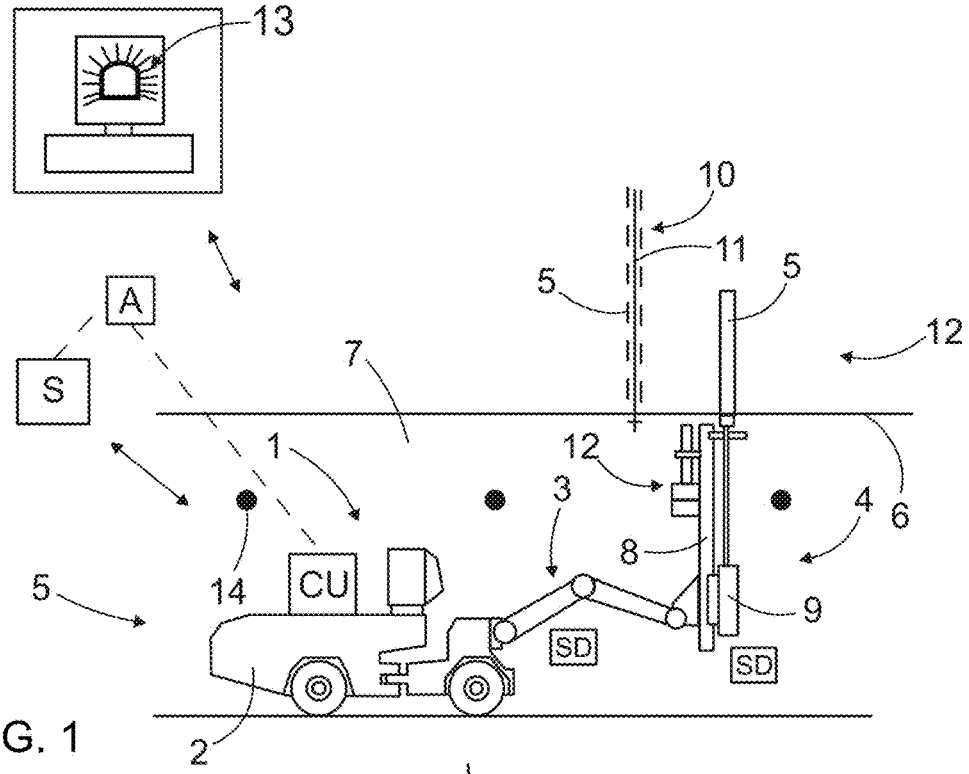
FIG. 1 is a schematic side view of a rock drilling rig provided with a drilling unit for drilling a drill hole pattern to rock surfaces of a tunnel or corresponding underground space.

FIG. 1 shows a rock drilling rig 1. The rock drilling rig 1 includes a movable carrier 2 and at least one drilling boom 3. The boom 3 is provided with a rock drilling unit 4 arranged for drilling drill holes 5 in rock surfaces 6 of an underground tunnel 7. The rock drilling unit 4 includes a feed beam 8 and rock drilling machine 9 mounted movably on the feed beam 8. When the rock drilling rig 1 is intended for mounting reinforcing elements 10, such as rock bolts 11 to the drill holes 5, a bolting head 12 in connection with the rock drilling unit 4 may be provided, or there may be a separate boom with a bolting head. Alternatively, the drill holes 5 may be drilled for excavating material by means of drill and blasts techniques. In both cases drill hole patterns 13 include several drill holes to be drilled. The drill hole pattern 13 may be pre-designed externally and can be transmitted to a control unit CU of the rock drilling rig 1, or alternatively an operator of the rock drilling rig 1 can design the drill hole pattern 13 in assistance with the control unit CU.

The drilling boom 3 and the drilling unit 4 are provided with sensing devices SD for gathering data on position and orientation so that the control unit CU can calculate position data of the rock drilling unit 4. Prior to initiating an actual drilling phase of the drill hole pattern 13, the rock drilling rig 1 is navigated to a work site. For example, position markings 14 made to rock surfaces 6 can be used for navigation purposes. In the navigation process the designed drill hole pattern 13 is connected to the actual drilling site. Furthermore, teaching of a collision free movement path is taught prior to initiating the actual drilling, as disclosed herein.

The teaching and generation process of the collision free movement path is executed by means of an apparatus A, which may be part of the control unit CU of the rock drilling rig 1, or it may be located externally, such as in connection with a server S, for example.

Figure 2:
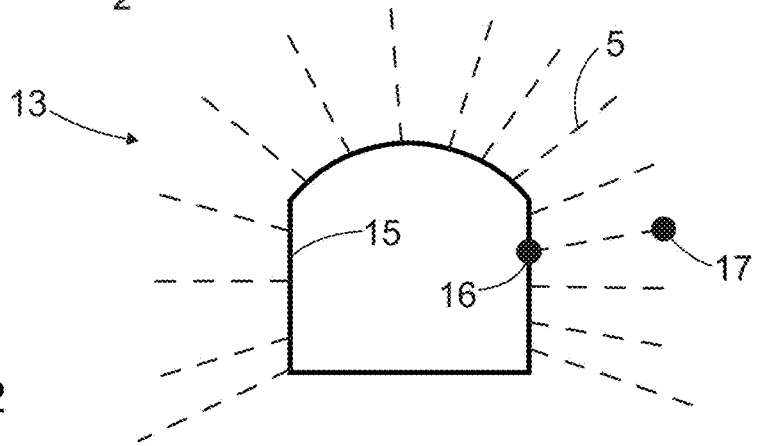
FIG. 2 is a schematic view of drill hole pattern including several drill holes in transverse direction of a tunnel.

FIG. 2 discloses a drill hole pattern 13 including several drill holes 5 having different orientations. Typically, the drill holes 5 are located in a same plane, which is transverse to a longitudinal direction of a tunnel. The drill hole pattern 13 is sometimes also called a drill hole fan. The drill hole pattern 13 includes a theoretical tunnel profile 15 and the drill holes 5 can be defined as coordinates of start points 16 and end points 17. The start points 16 are located on the theoretical tunnel profile 15. Orientation and length of the drill holes can be determined on the basis of the coordinates of the start points 16 and end points 17.

Figure 3:
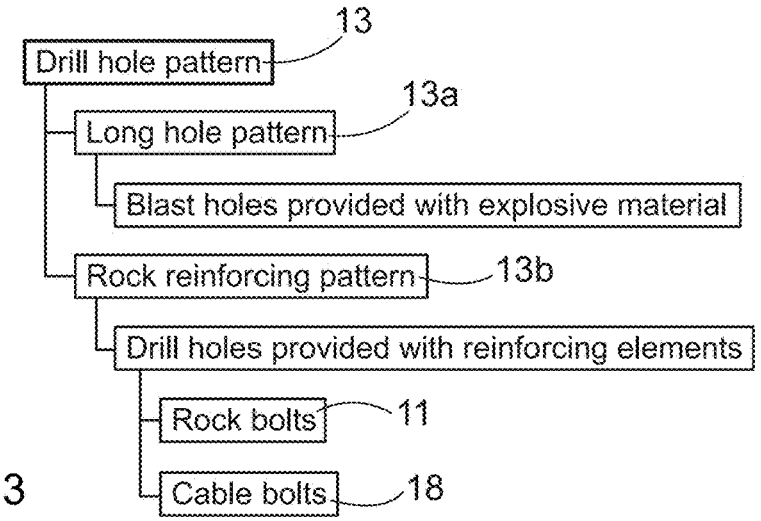
FIG. 3 is a schematic diagram showing typical types of drill hole patterns.

FIG. 3 discloses two different type of drill hole patterns 13. A long hole pattern 13*a* is a production type drill hole pattern for excavating rock material. The long hole pattern 13*a* includes blast holes, which are provided with explosive material. A rock reinforcing pattern 13*b*, or bolting pattern, includes several drill holes provided with reinforcing elements for supporting the rock material surrounding a tunnel. The reinforcing elements may be rock bolts 11 or cable bolts 18.

Figure 4:
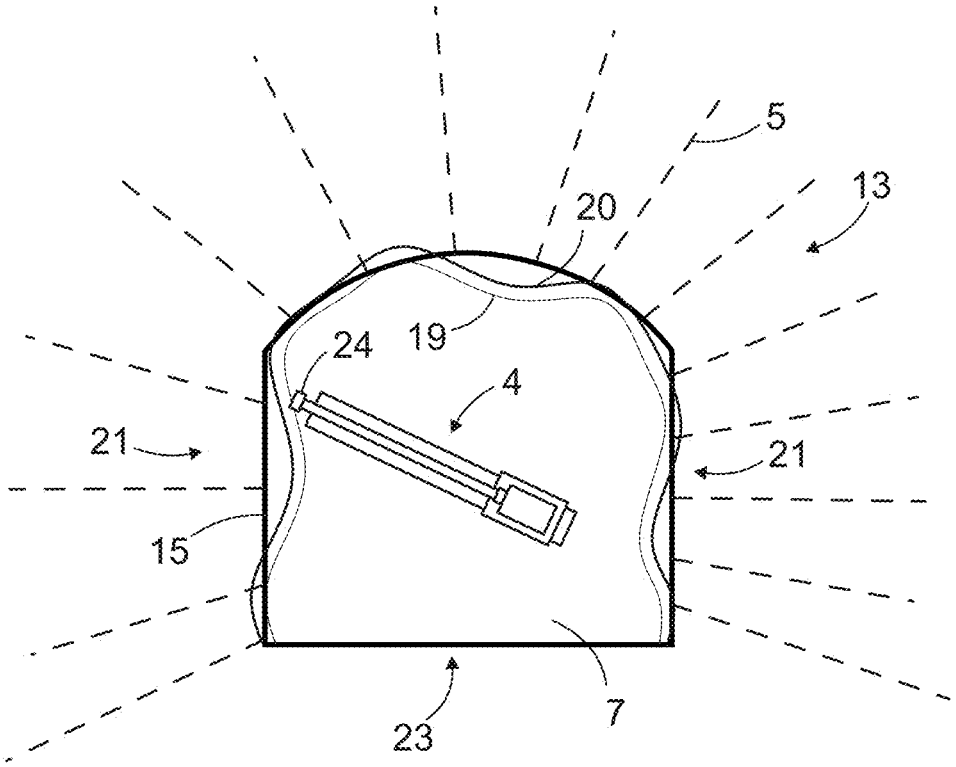
FIG. 4 is a schematic view showing a teaching process wherein a rock drilling unit is manually moved nearby realized rock surfaces.

FIG. 4 discloses a principle of forming a collision free movement path 19 inside a realized tunnel profile 20 at a location where a drill hole pattern 13 is to be drilled. The collision free movement path 19 is produced by manually moving a rock drilling unit 4 close to rock surfaces of the realized tunnel profile 20 and storing this movement path to be used later during the actual drilling phase. An operator of a rock drilling rig has good visibility of the realized tunnel profile 20 and can control movements of the rock drilling unit 4 for teaching the proper collision free movement path. Existing sensing devices of the rock drilling can be used for providing needed sensing data for generating position data, such as coordinates, for defining the collision free movement path. There is no need for separate and complicated sensing devices and thus the present solution is easy to also retrofit for different existing rock drilling rigs.

As shown in FIG. 4, the realized tunnel profile 20 deviates from a theoretical tunnel profile 15. That is because tunnel 7 is formed by drill and blast tunnelling techniques, wherein rock material is blasted. Due to the blasting, there is always some deviations in the shapes and dimensions of the actual tunnel. Further, the tunnel is usually dimensioned as small as possible for minimizing excavation costs. Due to these issues, there is a potential risk for colliding with rock surfaces of the tunnel. The disclosed teaching feature provides a solution for preventing collisions against walls 21, ceiling 22 and floor 23 of the tunnel 7.

In FIG. 4 a drill bit 24 of a drilling tool is moved to a close distance from the realize tunnel profile 20, i.e., from realized rock surfaces at the location of the drill hole pattern. However, it is possible to examine other elements of the rock drill unit when executing the teaching.

Figure 5:
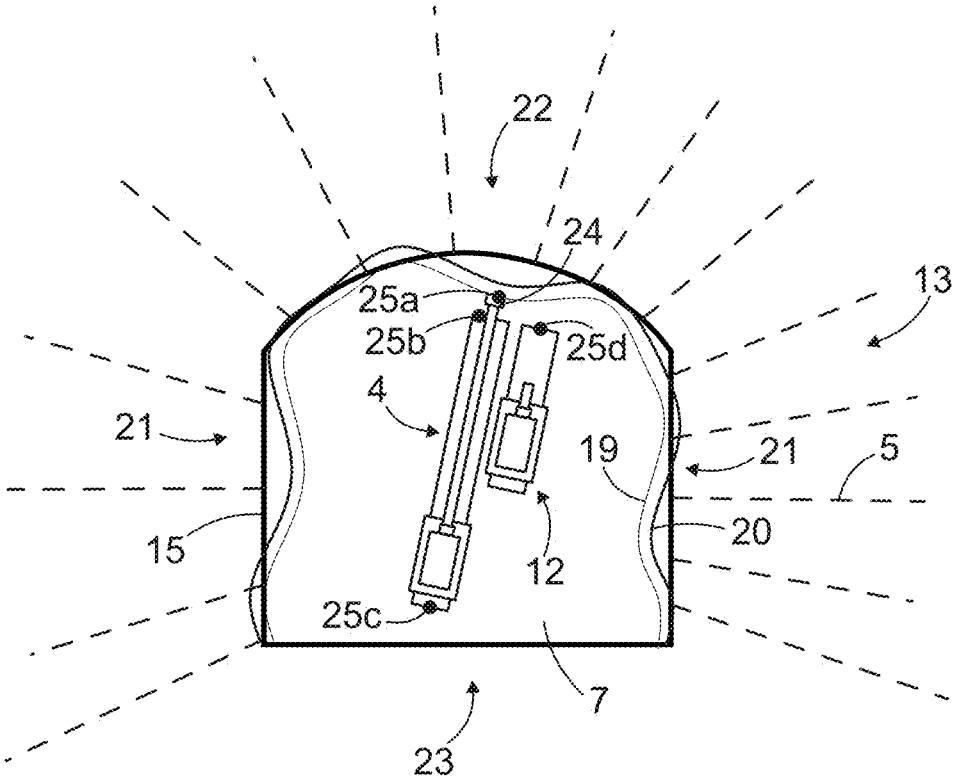
FIG. 5 is a schematic view of a manual teaching process wherein a rock drilling unit together with a bolting head is moved inside a tunnel profile.

In FIG. 5 rock drilling unit 4 includes bolting head 12. When teaching and generating a collision free movement path they are both examined. The collision free movement path can include one or more points 25*a*-25*d*, which are examined during the teaching. Coordinates of the selected points can be calculated and stored to define the taught collision free movement path. In FIG. 5 there is shown some possible locations for the examined points: a point 25*a* located at a drill bit 24, a point 25*b* located at a front end of the rock drilling unit 4, a point 25*c* located at a rear end of the rock drilling unit 4, and a point 25*d* located at a bolting head 12. In connection with the bolting head 12 there may be different apparatuses such as rock bolt and cable handling devices as well as rock bolt magazines and grout feeding means, which may be examined when teaching the collision free movement path.

It is also possible that the bolting head and the rock drilling unit are both in one combined mechanical structure and thereby form a unit which is monitored when examining the collision free movement path.

In FIGS. 4 and 5, exemplary collision free movement paths 19 are shown based on movement paths of the drill bit 24. The collision free movement path 19 may be created for any other selected point, or combinations of several examined points, and may thereby have different appearances when compared to the exemplary cases shown in FIGS. 4 and 5.

Figure 6:
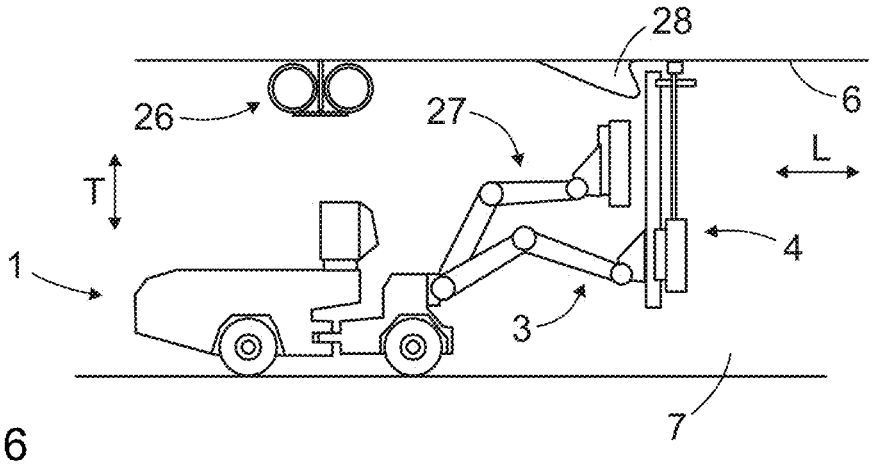
FIG. 6 is a schematic side view of rock drilling rig and possible physical obstacles in addition to rock surfaces of a tunnel.
Figure 7:
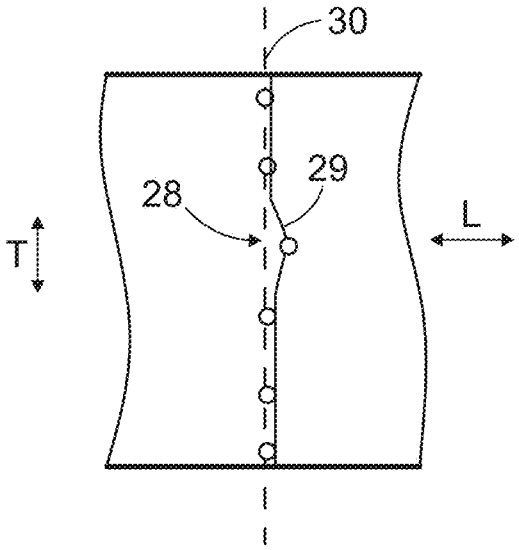
FIG. 7 is a schematic top view illustrating a physical obstacle protruding in a longitudinal direction of a tunnel and its effect on the generated collision free movement path.

FIG. 6 discloses that there may be other physical obstacles in a tunnel 7 in addition to rock surfaces 6, which need to be considered when executing drilling of drill hole patterns. For example, there may be infrastructure 26, such as ventilation ducts, arranged in the tunnel 7. The examined physical obstacles may also include structures of the rock drilling rig 1 itself. Accordingly, the generated collision free movement path includes avoiding colliding with other booms 27, for example. Further, rock surfaces 6 of the tunnel 7 may include protruding rock surfaces 28 in a longitudinal or length direction L of the tunnel 7. Thus, the limiting rock surfaces 6 may not only be in transverse direction T of the tunnel 7, but also longitudinally L and protruding rock surfaces 28 need to be considered when generating a collision free movement path. For avoiding collision with such longitudinally protruding surfaces 28 the generated collision free movement path may include sections 29 deviating from plane 30 and may thereby have a three-dimensional configuration, as it is shown in a simplified top view in FIG. 7.

Figure 8:
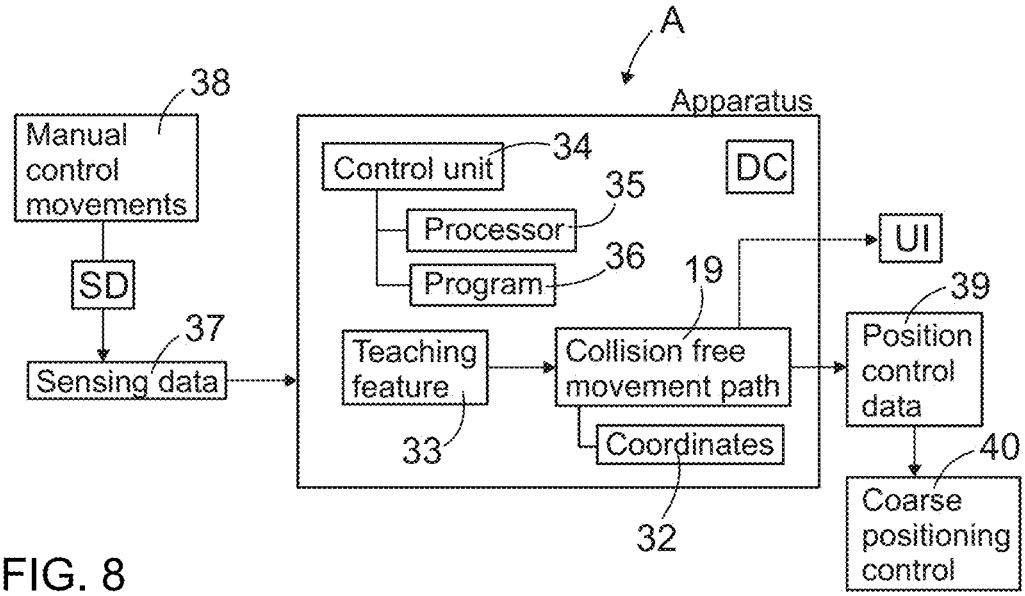
FIG. 8 is a schematic diagram showing some features and connections of an apparatus for implementing the disclosed solution.

FIG. 8 discloses a possible set up of apparatus A for generating a collision free movement path 19 including position data, such as coordinates 32 provided by executing a teaching feature 33 of apparatus A. Apparatus A includes a control unit 34 provided with a processor 35 and a computer program product 36 executable in the processor 35 for calculating the position control data and providing the collision free movement path 31. The execution of the teaching feature 33 includes gathering sensing data 37 from sensing devices SD when manual control movements 38 are executed. The apparatus A generates coordinates 32 for selected examination points and provides position control data 39 for controlling a rock drilling unit along the collision free movement path 19. The generated position control data 39 can be implemented when executing coarse position control 40 of the rock drilling unit, i.e., when moving the rock drilling unit close to designed drill hole start points of a drill hole pattern. The apparatus A may also include, or be in communication with, a user interface UI or display device for communicating the collision free movement path 19 and an approximation of a realized tunnel profile of the tunnel 7 for an operator of a rock drilling rig.

Apparatus A may be a part of a control unit or control system of the rock drilling rig, or alternatively apparatus A may be a separate device arranged to communicate with the control unit of the rock drilling rig via data communication connection or unit DC.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. An apparatus arranged for providing position control data for controlling positioning of a rock drilling unit of a rock drilling rig arranged for drilling transverse drill hole patterns to an underground tunnel, the apparatus comprising:

at least one control unit provided with sensing data on a position and orientation of the rock drilling unit; and a teaching feature, wherein the apparatus is configured to:

gather the sensing data on manually controlled movements of the rock drilling unit on a plane of the drill hole pattern to be drilled, and wherein the rock drilling unit is moved along a movement path at a distance from physical obstacles located at the drill hole pattern to be drilled;

generate a collision free movement path in response of the gathered sensing data; and implement the generated collision free movement path in the position control of the rock drilling unit; and wherein the apparatus is further provided with sensing data on manually controlled movements of the rock drilling unit in a transverse direction of the plane of the drill pattern and at a transverse distance from physical obstacles in the transverse direction, whereby the generated collision free movement path has a three-dimensional configuration.

2. The apparatus as claimed in claim 1, wherein the apparatus is further configured to examine a position of at least one selected point of the rock drilling unit and is configured to generate the collision free movement path for the at least one selected point.

3. The apparatus as claimed in claim 1, wherein the apparatus is further configured to implement the generated collision free movement path for generating control commands for automatic coarse positioning of the rock drilling unit on the plane of the drill hole pattern to defined locations of the drill holes of the drill hole pattern.

4. The apparatus as claimed in claim 1, wherein the apparatus is further configured to provide data on a realized tunnel profile of the tunnel in response to the received sensing data.

5. A rock drilling rig arranged for drilling transverse drill hole patterns in rock surfaces of an underground tunnel, the rock drilling rig comprising:

a movable carrier;

at least one boom;

at least one rock drilling unit supported on the at least one boom and including at least a feed beam and a rock drilling machine mounted movably on the feed beam;

sensing devices arranged for generating sensing data on movements of the boom and the rock drilling unit; and a control unit for controlling operation of the rock drilling rig, wherein the control unit is provided data on a collision free movement path at the drill hole pattern to be drilled and is configured to implement a collision free movement path in position control of the rock drilling unit, the collision free movement path being generated by an apparatus in accordance with claim 1.

6. The rock drilling rig as claimed in claim 5, wherein the rock drilling rig is a bolting rig including a bolting head supported on the boom and the bolting head having at least a rock bolt or cable feeding apparatus in addition to the rock drilling unit.

* * * * *